US010881205B2

(12) United States Patent
Angel

(10) Patent No.: US 10,881,205 B2
(45) Date of Patent: Jan. 5, 2021

(54) FURNITURE ANCHORING ASSEMBLY

(71) Applicant: Jeremy Angel, Marietta, GA (US)

(72) Inventor: Jeremy Angel, Marietta, GA (US)

( * ) Notice: Subject to any disclaimer, the term of this patent is extended or adjusted under 35 U.S.C. 154(b) by 0 days.

(21) Appl. No.: 16/359,594

(22) Filed: Mar. 20, 2019

(65) Prior Publication Data

US 2020/0297112 A1 Sep. 24, 2020

(51) Int. Cl.
*A47B 91/12* (2006.01)

(52) U.S. Cl.
CPC ..... *A47B 91/12* (2013.01)

(58) Field of Classification Search
USPC ..... 248/188.9, 345.1
See application file for complete search history.

(56) References Cited

U.S. PATENT DOCUMENTS 342,970 A 6/1886 Ongley
1,445,726 A * 2/1923 Soros ..... A47B 95/043 248/345.1
3,858,838 A * 1/1975 Woodhouse ..... A47B 95/043 248/345.1
3,869,106 A * 3/1975 Gregov ..... A47B 95/043 248/345.1
4,830,320 A 5/1989 Bellows
4,837,062 A * 6/1989 Dunshee ..... A61F 13/0216 428/41.3
4,946,727 A * 8/1990 Kessler ..... A47B 95/043 428/99
5,330,814 A * 7/1994 Fewell ..... A47B 95/043 248/345.1
5,592,901 A * 1/1997 Birmingham ..... A01K 15/024 119/706
5,799,921 A * 9/1998 Stattel ..... A47B 97/00 248/300
6,290,294 B1 9/2001 Volz
9,556,634 B2 * 1/2017 Hosmer ..... E04H 6/428
9,717,336 B1 8/2017 Apple
2005/0003723 A1 * 1/2005 Brouard ..... A47B 91/06 442/86
2011/0284710 A1 * 11/2011 Wallace ..... B32B 7/02 248/345.1
2013/0292535 A1 11/2013 Barja

* cited by examiner

*Primary Examiner* — Monica E Millner

(57) ABSTRACT

A furniture anchoring assembly includes a set of stops. Each of the stops has a first arm that is coupled to and forms an angle with respect to a second arm. In this way a leg space is defined between the first and second arms of each stop to receive a leg of an article of furniture. Moreover, each of the stops is positionable on a hard surface floor and is spaced from a wall to inhibit the article of furniture from sliding against the wall. A plurality of adhesive layers is each coupled to a respective one of the stops. Each of the adhesive layers adhesively engages the floor to inhibit the stops from sliding on the floor.

4 Claims, 5 Drawing Sheets

FURNITURE ANCHORING ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to anchoring devices and more particularly pertains to a new anchoring device for inhibiting furniture from sliding against a wall.

BRIEF SUMMARY OF THE INVENTION

An embodiment of the disclosure meets the needs presented above by generally comprising a set of stops. Each of the stops has a first arm that is coupled to and forms an angle with respect to a second arm. In this way a leg space is defined between the first and second arms of each of the stops to receive a leg of an article of furniture. Moreover, each of the stops is positionable on a hard surface floor and is spaced from a wall to inhibit the article of furniture from sliding against the wall. A plurality of adhesive layers is each coupled to a respective one of the stops. Each of the adhesive layers adhesively engages the floor to inhibit the stops from sliding on the floor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
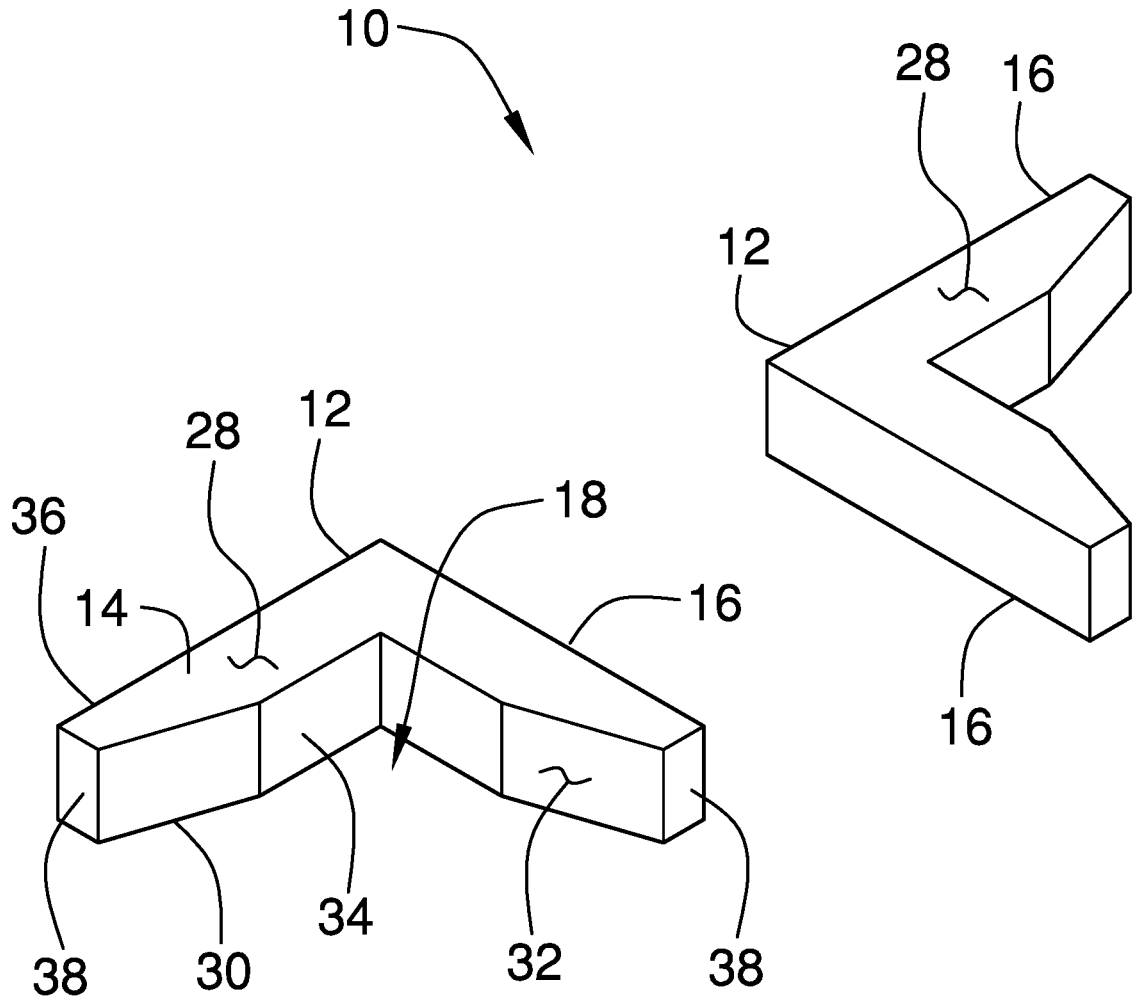
FIG. 1 is a top perspective view of a stop of a furniture anchoring assembly according to an embodiment of the disclosure.
Figure 2:
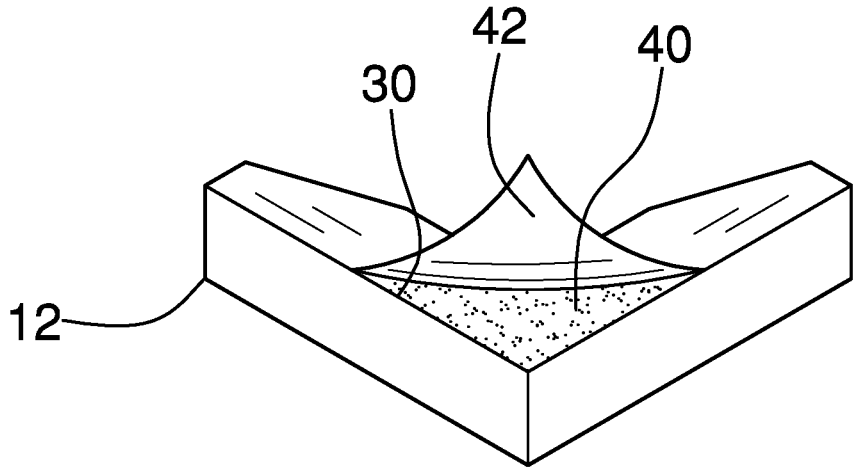
FIG. 2 is a bottom perspective view of a stop of an embodiment of the disclosure.
Figure 3:
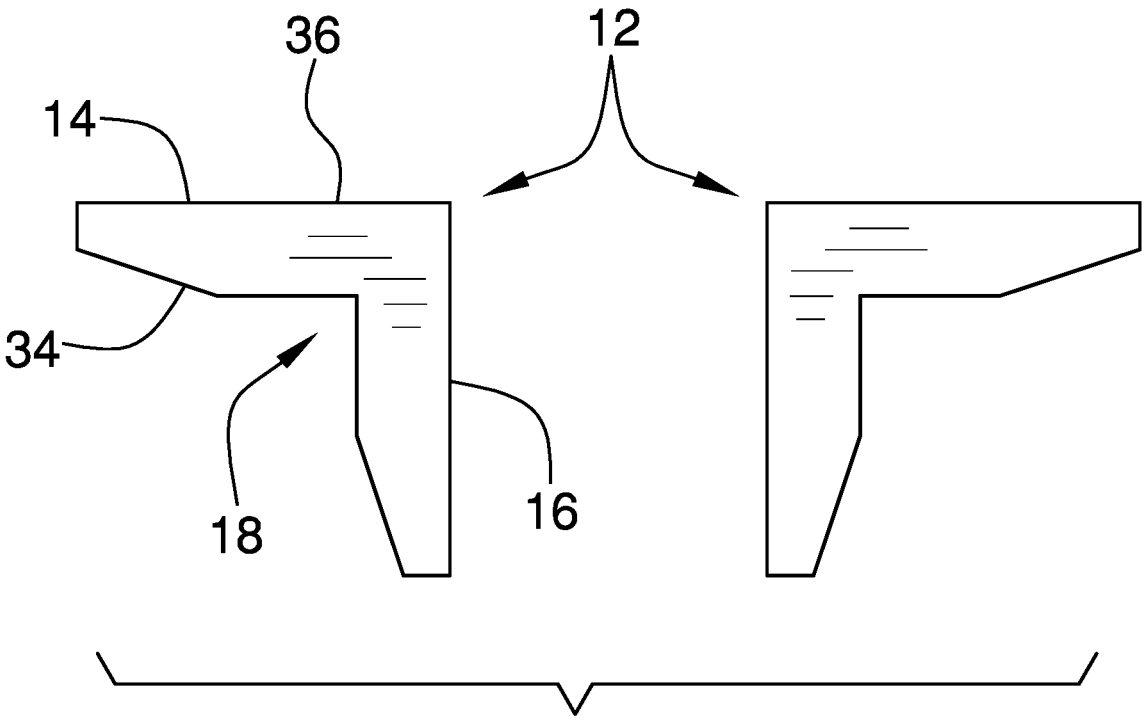
FIG. 3 is a top view of set of stops of an embodiment of the disclosure.
Figure 4:
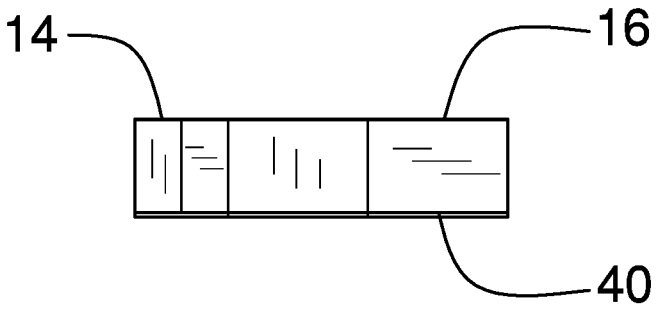
FIG. 4 is a right side view of stop of an embodiment of the disclosure.
Figure 5:
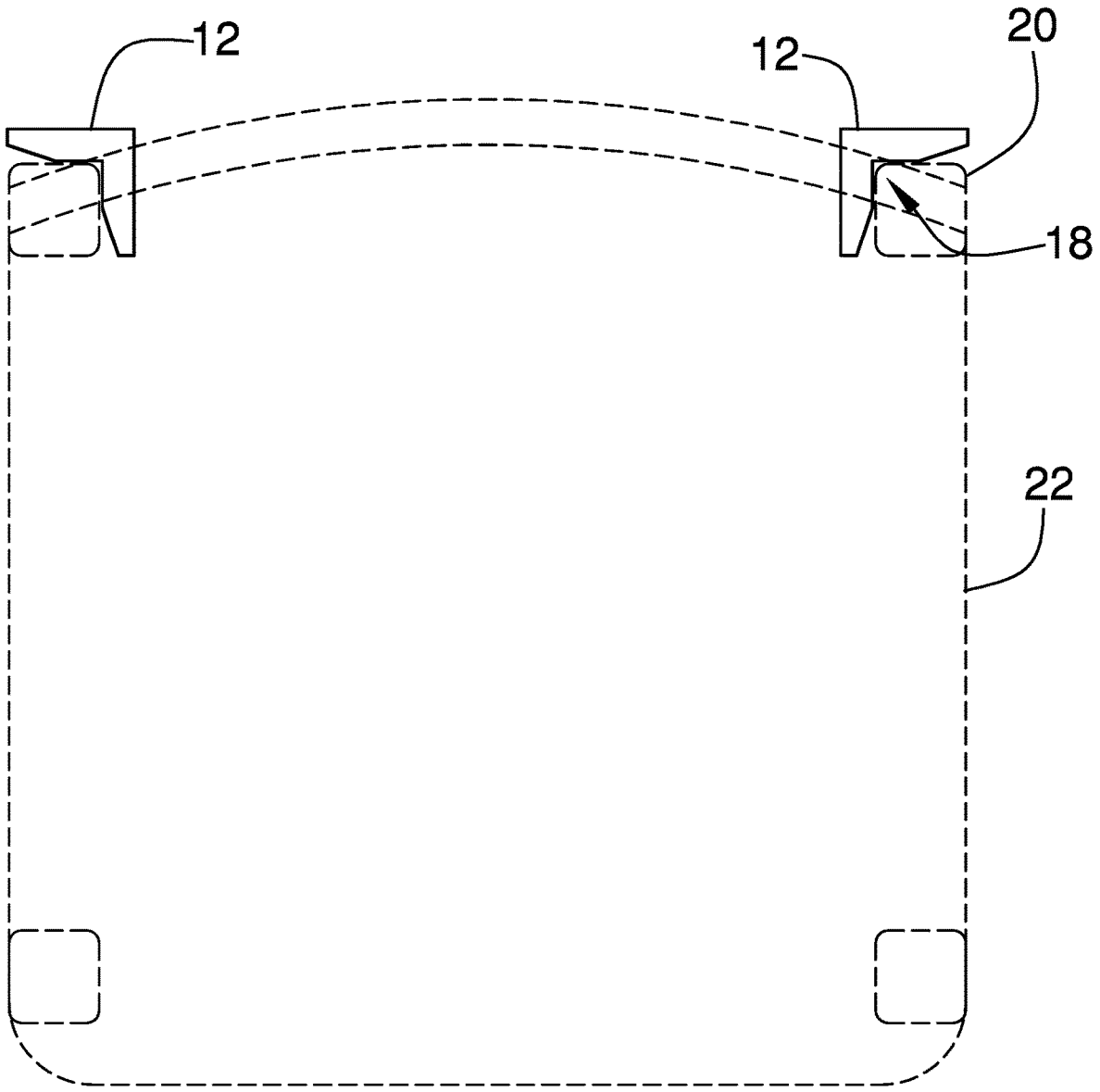
FIG. 5 is a top phantom in-use view of an embodiment of the disclosure.
Figure 6:
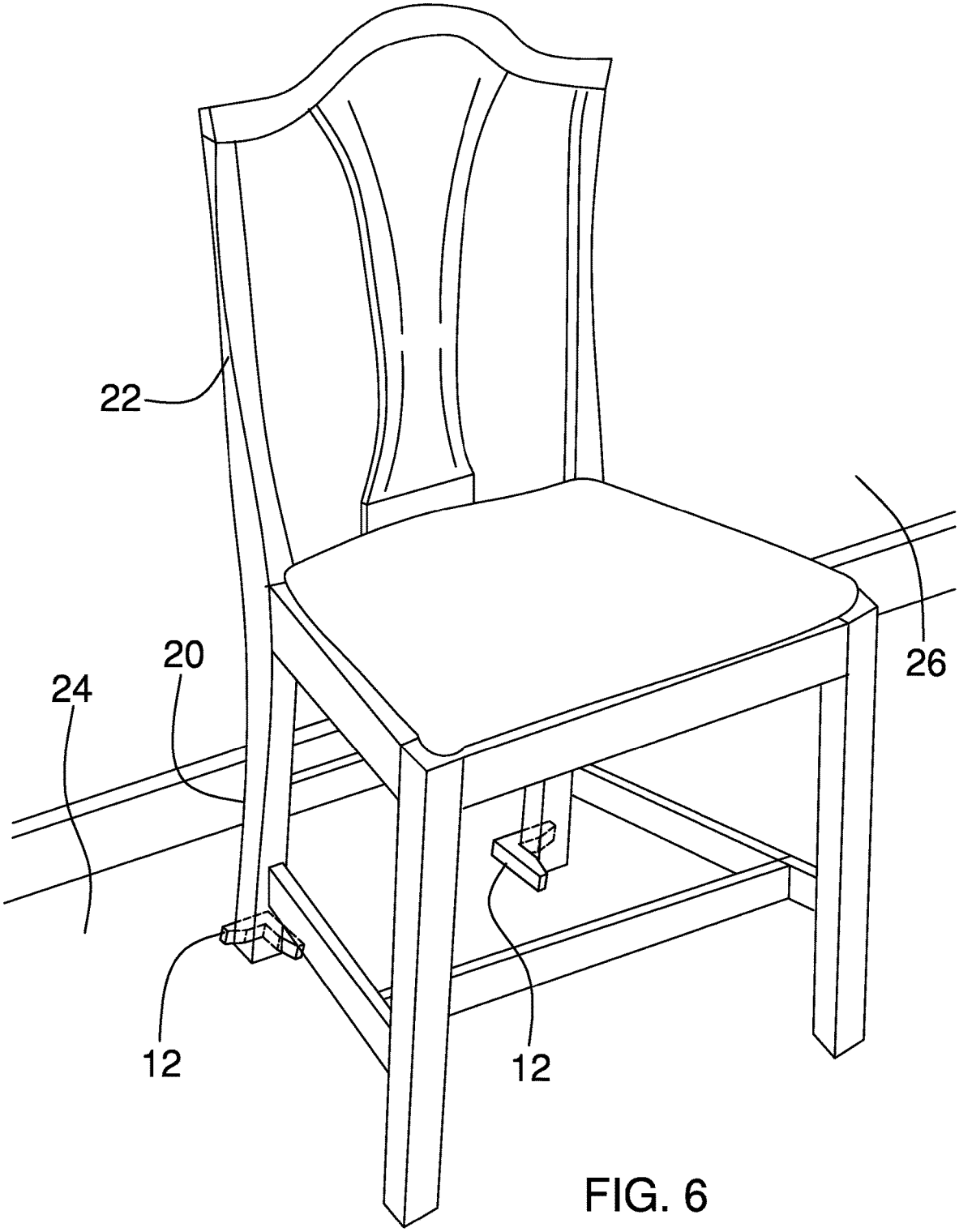
FIG. 6 is a perspective in-use view of an embodiment of the disclosure.

With reference now to the drawings, and in particular to FIGS. 1 through 6 thereof, a new anchoring device embodying the principles and concepts of an embodiment of the disclosure and generally designated by the reference numeral 10 will be described.

As best illustrated in FIGS. 1 through 6, the furniture anchoring assembly 10 generally comprises a set of stops 12 that each has a first arm 14 that is coupled to and forms an angle with respect to a second arm 16. Thus, a leg space 18 is formed between the first 14 and second 16 arms for receiving a leg 20 of an article of furniture 22. The angle formed between the first 14 and second 16 arms may be a right angle to conform to a potentially square shaped leg 20. The article of furniture 22 may be a chair, a couch or any other article of furniture 22 that has at least two rear legs 20, and each of the rear legs 20 are positioned into the leg space 18 in the respective stop 12. Each of the stops 12 is positionable on a hard surface floor 24, such as hardwood floor, linoleum or other hard surface. Additionally, each of the stops 12 is spaced from a wall 26 to inhibit the article of furniture 22 from sliding against the wall 26. In this way the stops 12 inhibit the article of furniture 22 from contacting the wall 26 and thusly marking or otherwise damaging the wall 26.

Each of the stops 12 has a top surface 28, a bottom surface 30 and an outer surface 32 extending therebetween, and the outer surface 32 of each of the stops 12 has a front side 34 and a back side 36. Each of the first 14 and second 16 arms of each of the stops 12 has a distal end 38 with respect to an intersection of the first 14 and second 16 arms. Moreover, the front side 34 of the outer surface 32 of each of the stops 12 lies on a plane that is oriented parallel to the back side 36 of the outer surface 32. The front side 34 is parallel to the back side 36 between an intersection between the first 14 and second 16 arms and a center of the first 14 and second 16 arms. Additionally, the front side 34 of the outer surface 32 of each of the stops 12 angles toward the back side 36 of the outer surface 32 between the center of a respective one of the first 14 and second 16 arms and the distal end 38 of the respective first 14 and second 16 arms.

The bottom surface 30 of each of the stops 12 rests on the hard surface floor 24 having the leg space 18 in each of the stops 12 being directed away from a wall 26. The stops 12 are spaced apart from each other on the hard surface floor 24 a distance corresponding to the spacing between the legs 20 of the article of furniture 22. Moreover, the stops 12 are spaced from the wall 26 having the first arm 14 of each of the stops 12 extending along a line being oriented parallel to the wall 26 and having the second arm 16 of each of the stops 12 extending along a line that is oriented parallel to each other.

A plurality of adhesive layers 40 is each coupled to a respective one of the stops 12 and each of the adhesive layers 40 adhesively engages the floor 24. In this way each of the stops 12 is inhibited from sliding on the floor 24. Each of the adhesive layers 40 is positioned on and completely covers the bottom surface 30 of the respective stop 12. Each of the adhesive layers 40 may comprise double sided tape or other type of single use adhesive. A plurality of protective sheets 42 is each removably positioned over the adhesive layer 40 on a respective one of the stops 12. Each of the protective sheets 42 is removable from the adhesive layer 40 on the respective stop 12 before the respective stop 12 is positioned on the hard surface floor 24.

In use, the protective sheet 42 is removed from the adhesive layer 40 of the stops 12 and each of the stops 12 is positioned on the hard surface floor 24 being spaced from the wall 26. Additionally, the stops 12 are spaced apart from each other a distance that corresponds to the spacing of the legs 20 on the article of furniture 22. The legs 20 on the article of furniture 22 are positioned in the leg space 18 in each of the stops 12. Thus, when an individual sits on the article of furniture 22, the article of furniture 22 is inhibited from sliding against the wall 26 and thusly marking or otherwise damaging the wall 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A furniture anchoring system comprising:

an article of furniture have a pair of legs;

a set of stops, each of said stops having a first arm being coupled to and forming an angle with respect to a second arm thereby forming a leg space between said first and second arms of each of said stops wherein said leg space in each of said stops is shaped to receive a respective one of said legs of said article of furniture, each of said stops being configured to be positionable on a hard surface floor and being configured to be spaced from a wall wherein each of said stops inhibits the article of furniture from sliding against the wall, each of said first and second arms having a length corresponding to a respective width of an associated face of the respective one of said legs wherein a respective free end of each of said first and second arms is inhibited from protruding outwardly with respect to said respective one of said legs;

a plurality of adhesive layers, each of said adhesive layers being coupled to a respective one of said stops, each of said adhesive layers being configured for adhesively engaging the floor wherein each of said stops is configured to be inhibited from sliding on the hard surface floor;

each of said stops having a top surface, a bottom surface, and an outer surface extending therebetween, said outer surface of each of said stops having a front side and a back side, each of said first and second arms of each of said stops having a distal end with respect to an intersection of said first and second arms;

said front side of said outer surface of each of said stops lying on a plane being oriented parallel to said back side of said outer surface between an intersection between said first and second arms and a center of said first and second arms; and said front side of said outer surface of each of said stops angling toward said back side of said outer surface between said center of a respective one of said first and second arms and said distal end of said respective first and second arm.

2. The system according to claim 1, wherein said bottom surface of each of said stops rests on the hard surface floor having said leg space in each of said stops being directed away from a wall, said stops being spaced apart from each other on the floor a distance corresponding to a spacing between the pair of legs of the article of furniture, said stops being spaced from the wall having said first arm of each of said stops extending along a line being oriented parallel to the wall and having said second arm of each of said stops extending along a line being oriented parallel to each other.

3. The system according to claim 1, wherein:

each of said adhesive layers is positioned on and completely covers said bottom surface of said respective stop; and said assembly further comprises a plurality of protective sheets, each of said protective sheets being removably positioned over said adhesive layer on a respective one of said stops, each of said protective sheets being removable from said adhesive layer on said respective stop before said respective stop is positioned on the hard surface floor.

4. A furniture anchoring system comprising:

an article of furniture having a pair of legs;

a set of stops, each of said stops having a first arm being coupled to and forming an angle with respect to a second arm thereby forming a leg space between said first and second arms of each of said stops wherein said leg space in each of said stops is shaped to receive a respective one of the legs of the article of furniture, each of said stops being configured to be positionable on a hard surface floor and being spaced from a wall wherein each of said stops inhibits the article of furniture from sliding against the wall, each of said stops having a top surface, a bottom surface, and an outer surface extending therebetween, said outer surface of each of said stops having a front side and a back side, each of said first and second arms of each of said stops having a distal end with respect to an intersection of said first and second arms, said front side of said outer surface of each of said stops lying on a plane being oriented parallel to said back side of said outer surface, said front side being parallel to said back side between an intersection between said first and second arms and a center of said first and second arms, said front side of said outer surface of each of said stops angling toward said back side of said outer surface between said center of a respective one of said first and second arms and said distal end of said respective first and second arm, said bottom surface of each of said stops resting on the hard surface floor having said leg space in each of said stops being directed away from a wall, said stops being spaced apart from each other on the floor a distance corresponding to a spacing between the legs of the article of furniture, said stops being spaced from the wall having said first arm of each of said stops extending along a line being oriented parallel to the wall and having said second arm of each of said stops extending along a line being oriented parallel to each other, each of said first and second arms having a length corresponding to a respective width of an associated face of the respective one of said legs wherein a respective free end of each of said first and second arms is inhibited from protruding outwardly with respect to said respective one of said legs;

a plurality of adhesive layers, each of said adhesive layers being coupled to a respective one of said stops, each of said adhesive layers adhesively engaging the floor wherein each of said stops is configured to be inhibited from sliding on the floor, each of said adhesive layers being positioned on and completely covering said bottom surface of said respective stop; and a plurality of protective sheets, each of said protective sheets being removably positioned over said adhesive layer on a respective one of said stops, each of said protective sheets being removable from said adhesive layer on said respective stop before said respective stop is positioned on the floor.

* * * * *